US005920749A

United States Patent [19]

Sugaya et al.

[11] Patent Number: 5,920,749

[45] Date of Patent: Jul. 6, 1999

[54] IMAGE FORMING APPARATUS WITH TIME DELAYED COOLING CONTROL

[75] Inventors: Tsutomu Sugaya; Makoto Okado; Junichi Takamatsu, all of Osaka, Japan

[73] Assignee: Mita Industrial Co., Ltd., Osaka, Japan

[21] Appl. No.: 08/814,951

[22] Filed: Mar. 10, 1997

[30] Foreign Application Priority Data

Mar. 13, 1996 [JP] Japan ..... 8-056016

[51] Int. Cl.[6] ..... G03G 15/20

[52] U.S. Cl. ..... 399/69; 399/70

[58] Field of Search ..... 399/67, 69, 70, 399/94, 334; 219/216

[56] References Cited

U.S. PATENT DOCUMENTS 5,307,132 4/1994 Tsuchiya ..... 399/70

5,521,686 5/1996 Muto ..... 399/69

5,555,075 9/1996 Fukano et al. ..... 399/69

*Primary Examiner*—Arthur T. Grimley

*Assistant Examiner*—Hoan Tran

*Attorney, Agent, or Firm*—Jordan and Hamburg LLP

[57] ABSTRACT

An image forming apparatus which forms a toner image which is transferred onto a copy sheet includes a fixing unit having a heater for fixing the toner image onto the copy sheet at a predetermined fixing temperature. A cooling unit operates at a first cooling state for cooling the fixing unit. A mode selector is provided for setting a mode of the image forming apparatus to an energy saving mode in which heating operation by the heater is halted. A cooling controller suspends cooling operation of the cooling unit after a delay following a time when the image forming apparatus is set to the energy saving mode.

18 Claims, 3 Drawing Sheets

IMAGE FORMING APPARATUS WITH TIME DELAYED COOLING CONTROL

BACKGROUND OF THE INVENTION

This invention relates to an electro-photography type image forming apparatus capable of suppressing energy consumption.

Conventionally, image forming apparatuses of the electro-photography type have been constructed in such a manner that an electrostatic latent image formed on a surface of a photosensitive member in an imaging assembly is developed into a toner image by electrically attracting toner particles to the latent image, the thus formed toner image is transferred onto a copy sheet which is fed from a sheet storage portion to an image exposure position on the surface of the photosensitive member and fixed in a fixing unit, and then the copy sheet carrying the fixed toner image is discharged outside of the image forming apparatus.

In such an image forming apparatus, a so-called thermal fusion and fixing method has been adopted in the fixing unit for the purpose of high speed image fixation and safe operation. Specifically, according to the thermal fusion and fixing method, the fixing unit includes a pair of rollers including a heater roller internally provided with a heater and a presser roller. The presser roller is pressed against the heater roller with a specified pressure. While a copy sheet carrying a transferred toner image is transported between the heater roller and the presser roller, the toner image is fused by heat of the heater roller which is heated at a predetermined temperature (e.g., about 200° C.) for image fixation by the heater (or merely fixing temperature), while being pressed against the copy sheet with the specified pressure, thereby fixing the toner image onto the copy sheet.

In order to prevent a fluctuation of temperature, the heater of the heater roller has a large heat capacity and thus consumes a great amount of power.

The image forming apparatus is provided with a fan in the proximity of the fixing unit for cooling peripheral devices (suppressing rise of the temperature) arranged in the vicinity of the fixing unit. By dispersing heated air in the vicinity of the fixing unit with the use of the fan and exhausting the heated air to outside of the image forming apparatus through an escaping hole formed in the apparatus main body, rise of the temperature of the peripheral devices is suppressed.

It is often the case that the image forming apparatus is put into a stand-by mode where copying is not performed, after a main switch for the apparatus is turned on to supply power thereto, which results in a waste of energy. To suppress energy consumption of the image forming apparatus during the stand-by mode, the image forming apparatus is provided with energy saving mode which is operated when a predetermined time duration lapses after the apparatus enters a stand-by mode.

When the apparatus is set to the energy saving mode, heating operation of the heater in the heater roller is suspended (or energization of the heater power supply is leveled down) to put the heater into a pre-heated state in which a surface temperature of the heater roller is maintained at a level lower than the fixing temperature. At the time of suspending driving of the heater or leveling down of the heater power supply, operation of the fan is simultaneously suspended (halted). At this state, a message indicative that the image forming apparatus is in the energy saving mode is displayed.

The above conventional image forming apparatus has the following problems. As mentioned above, when the image forming apparatus is set to energy saving mode, leveling down of the heater power supply is conducted simultaneously with suspending the operation of the fan. In such case, even after the heater power supply is leveled down when the image forming apparatus is set to the energy saving mode, the heater, which has a large heat capacity as previously mentioned, still radiates heat, and such radiant heat is transmitted to the peripheral devices of the fixing unit, because the radiant heat is no longer dispersed and exhausted by the operation of the fan. The thus transmitted radiant heat at some point in time raises the temperature of the peripheral devices arranged near the fixing unit, thereby adversely affecting the peripheral devices, in particular, causing adverse effects to the devices made of synthetic resin which are subjected to heat deformation and thermal fatigue.

SUMMARY OF THE INVENTION

In view of the above, it is an object of the invention to solve the above drawbacks residing in the prior art.

It is another object of the invention to provide an image forming apparatus capable of preventing a temperature rise of peripheral devices in the vicinity of a fixing unit after the image forming apparatus is set to an energy saving mode.

It is still another object of the invention to provide an image forming apparatus capable of suppressing energy consumption as much as possible.

To accomplish the above objects, the present invention is directed to an image forming apparatus of an electro-photography type in which a toner image, obtained by electrically attracting toner to an electrostatic latent image, is transferred onto a copy sheet, the image forming apparatus comprising a fixing unit having a heater for fixing the transferred toner image onto the copy sheet with heat of the heater which is maintained at a predetermined fixing temperature; a cooling unit operable at a first cooling state for cooling the fixing unit; a mode selector for setting a mode of the image forming apparatus to an energy saving mode in which heating operation of the heater is halted when an image forming operation is suspended for a predetermined time duration; and a cooling controller for delaying a suspension of the cooling operation of the cooling unit from a time period after the image forming apparatus is set to the energy saving mode.

With this arrangement, undesirable rise of the temperature of the fixing unit after the image forming apparatus is set to energy saving mode can be avoided. Thereby, the possibility of adverse effects (e.g., heat deformation and thermal fatigue) occurring on peripheral devices which are arranged in the periphery of the fixing unit due to the rise of the temperature of the fixing unit can be assuredly prevented. In another aspect of the invention, the cooling controller may include a cooling capability controller for controlling a cooling capability of the cooling unit, the cooling unit being selectively operable at a first cooling state and a second cooling state wherein the first cooling state has a superior cooling capability compared to that of the second cooling state, and the cooling capability of the cooling member is set to the second cooling state by the cooling controller when the image forming apparatus is set to the energy saving mode.

With this arrangement, power consumption required for driving the cooling member can be reduced.

In yet another aspect of the invention, the image forming apparatus may further include a heater controller for maintaining a temperature on a surface of the fixing unit at a level lower than the fixing temperature by controlling a heater power supply when the image forming apparatus is set to the energy saving mode.

With this arrangement, power consumption required for the heating operation by the heater can be reduced during a period when the apparatus is set to energy saving mode. Further, time required for the image forming apparatus to recover to an operational mode from the energy saving mode can be shortened, because the surface temperature of the heater roller of the fixing unit during the energy saving mode no longer falls beyond a certain level.

In still another aspect of the invention, the image forming apparatus may still further include a temperature detector for detecting a temperature in a main body of the image forming apparatus, and judgment means for judging whether or not the temperature in the main body of the image forming apparatus begins falling when the image forming apparatus is set to the energy saving mode, the cooling controller halts cooling operation of the cooling unit when the judgment means judges that the temperature in the main body of the image forming apparatus begins falling.

With this arrangement, power consumption for the image forming apparatus can be further suppressed and undesirable rise of the temperature of the fixing unit prevented.

In a still further aspect of the invention, the judgment means may include a detection controller for having the temperature detector detect the temperature in the main body of the image forming apparatus at predetermined intervals, and a comparator for comparing a currently detected temperature with a previously detected temperature, wherein the judgment means judges whether or not the temperature in the main body of the image forming apparatus shows a sign of decreasing.

With this arrangement, power consumption for the image forming apparatus can be further suppressed with a simplified construction and undesirable rise of the temperature of the fixing unit prevented.

The above and other objects, features and advantages of the present invention will become more apparent upon a reading of the following detailed description and drawings.

DETAILED DESCRIPTION OF THE INVENTION

Figure 1:
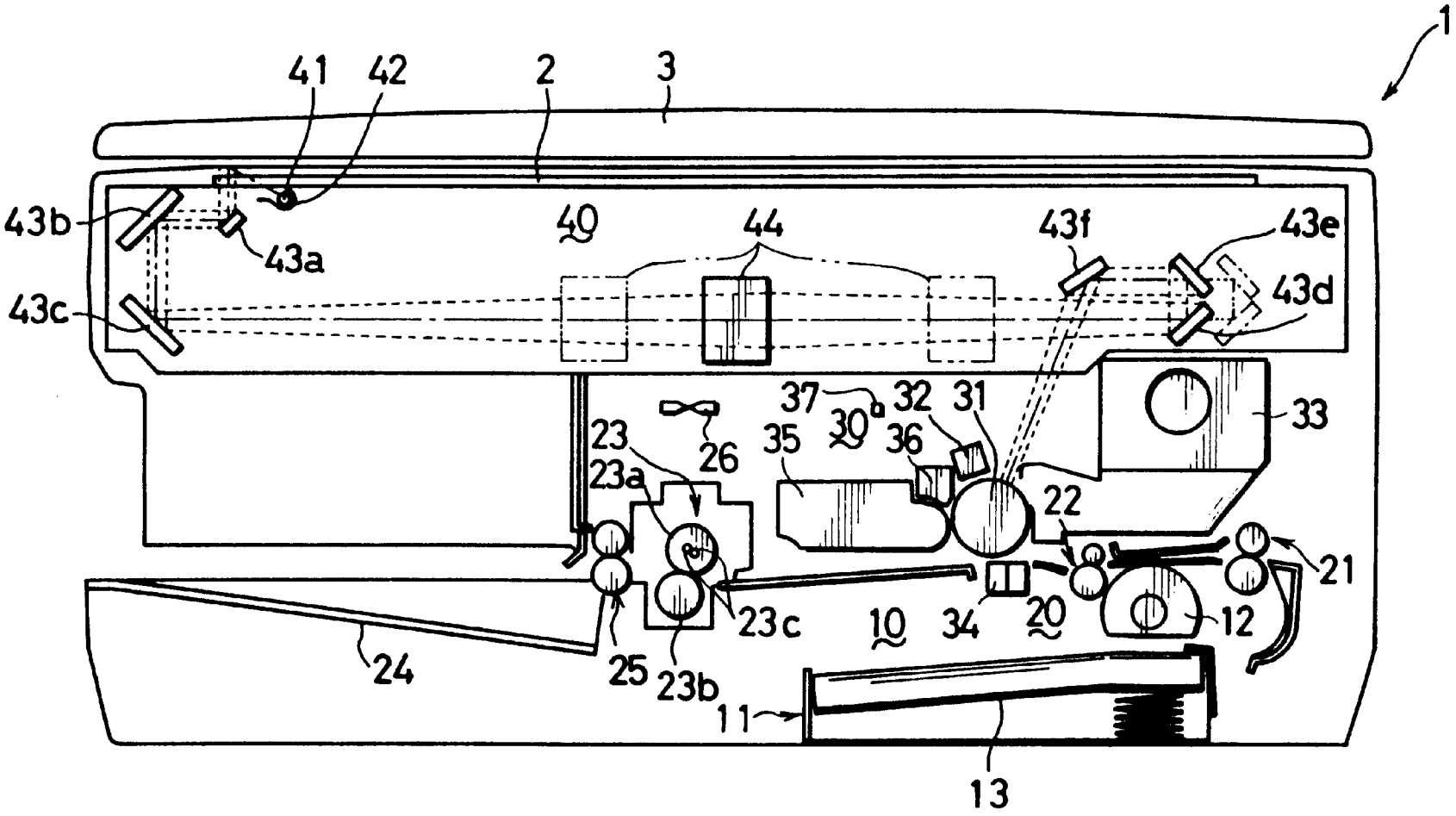
FIG. 1 is a front view showing an internal arrangement of an embodiment of an image forming apparatus according to this invention.

FIG. 1 is a front view showing an internal arrangement of an embodiment of an image forming apparatus according to this invention.

In FIG. 1, denoted at 1 is a main body of the image forming apparatus. The apparatus main body 1 comprises a sheet storage portion 10 disposed at a lower portion thereof, a sheet transport unit 20 disposed above the sheet storage portion 10, an imaging assembly 30 arranged above the sheet transport unit 20, and an optical system 40 disposed above the imaging assembly 30. The apparatus main body 1 further has a contact glass 2 arranged in the middle of a top portion thereof, and a document presser 3 for pressing a document placed on the contact glass 2 at a specified pressure.

The sheet storage portion 10 comprises a cassette 11 for accommodating a stack of copy sheets therein and a feed roller 12 which is disposed on the right end side, above the cassette 11 in FIG. 1. The cassette 11 has a sheet placement plate 13 with a lead end thereof urged upward by a spring to stack copy sheets thereon. The feed roller 12 has a substantially semicircular cross section including a flat portion and a curved portion. When in a stationary state, the feed roller 12 is set such that the flat portion faces the cassette 11 so as not to obstruct mounting and dismounting operations of the cassette in and out of the apparatus main body.

The optical system 40 comprises an exposure lamp 41, reflector 42, reflective mirrors 43*a*, 43*b*, 43*c*, 43*d*, 43*e*, and 43*f*, and lens unit 44. The exposure lamp 41, reflector 42, and reflective mirrors 43*a* are moved at a specified speed, and the reflective mirrors 43*b* and 43*c* are moved at a specified speed in the right and left on the plane in FIG. 1 (or merely scan direction). When these elements of the optical system 40 move reciprocally within a specified area to scan an image of an original document placed on the contact glass 2, a light image of document image is formed on a photosensitive surface of a photosensitive drum 31.

The imaging assembly 30 has the photosensitive surface formed as the photosensitive drum 31 which is rotatably supported about its rotational axis, and further comprises a main charger 32, developing unit 33, transfer/separation unit 34, cleaner 35, and blank lamp 36 in the periphery of the photosensitive drum 31 from an upstream side in this order with respect to the rotating direction of the photosensitive drum 31.

The main charger 32 charges a surface of the photosensitive drum 31 uniformly at a specified potential. A specified area of the photosensitive drum surface, immediately downstream of the main charger 32, is exposed to a light image of an original document image directed from the optical system 40 to form an electrostatic latent image thereon. The developing unit 33 is adapted for developing the latent image into a toner image by electrically attracting charged toner particles to the latent image.

The transfer/separation unit 34 is adapted for transferring the toner image onto a copy sheet and separating the same after the image transfer from the surface of the photosensitive drum 31. The cleaner 35 is adapted for removing residues of toner particles on the photosensitive drum surface after the image transfer, and the blank lamp 36 is adapted for removing residues of electric charges on the photosensitive drum surface.

The sheet transport unit 20 comprises a transport roller pair 21, registration roller pair 22, a fixing unit 23, a discharge tray 24, and a discharge roller pair 25 arranged from an upstream side in this order with respect to the sheet transport direction. Specifically, a copy sheet dispensed from the sheet storage portion 10 is fed toward the photosensitive drum 31 by the transport roller pair 21, transported further downstream by the registration roller pair 22 as timed with a scan timing of the optical system 40, and discharged onto the discharge tray 24 via the discharge roller pair 25 after having a toner image fixed thereon in the fixing unit 23.

The fixing unit 23 comprises a heater roller 23*a* and a presser roller 23*b*. The heater roller 23*a* is internally provided with a heater 23*c*, and further has an unillustrated temperature sensor for detecting a temperature of a surface of the heater roller 23*a*. The surface temperature of the heater roller 23*a* is maintained at a predetermined fixing temperature (e.g., about 200° C.) at which a transferred toner image is optimally fixed onto a copy sheet by controlling turn on of the heater 23*c*. The presser roller 23*b* has a surface thereof made of a material slightly softer than the surface of the heater roller 23*a* and is pressed against the heater roller 23*a* with a specified pressing force.

The apparatus main body 1 has a fan (cooling unit) 26 provided at an appropriate position above the fixing unit 23, and a temperature sensor 37 provided at an appropriate position in the imaging assembly 30. The fan 26 is driven to diffuse and exhaust the heated air in the apparatus main body to outside of the image forming apparatus through an unillustrated opening (escaping hole) formed in the apparatus main body 1. Thereby, rise of temperature of the fixing unit 23 as well as peripheral devices arranged in the vicinity of the fixing unit 23 is suppressed. The temperature sensor 37 includes a thermistor and is adapted for detecting the temperature inside the apparatus main body 1.

Figure 2:
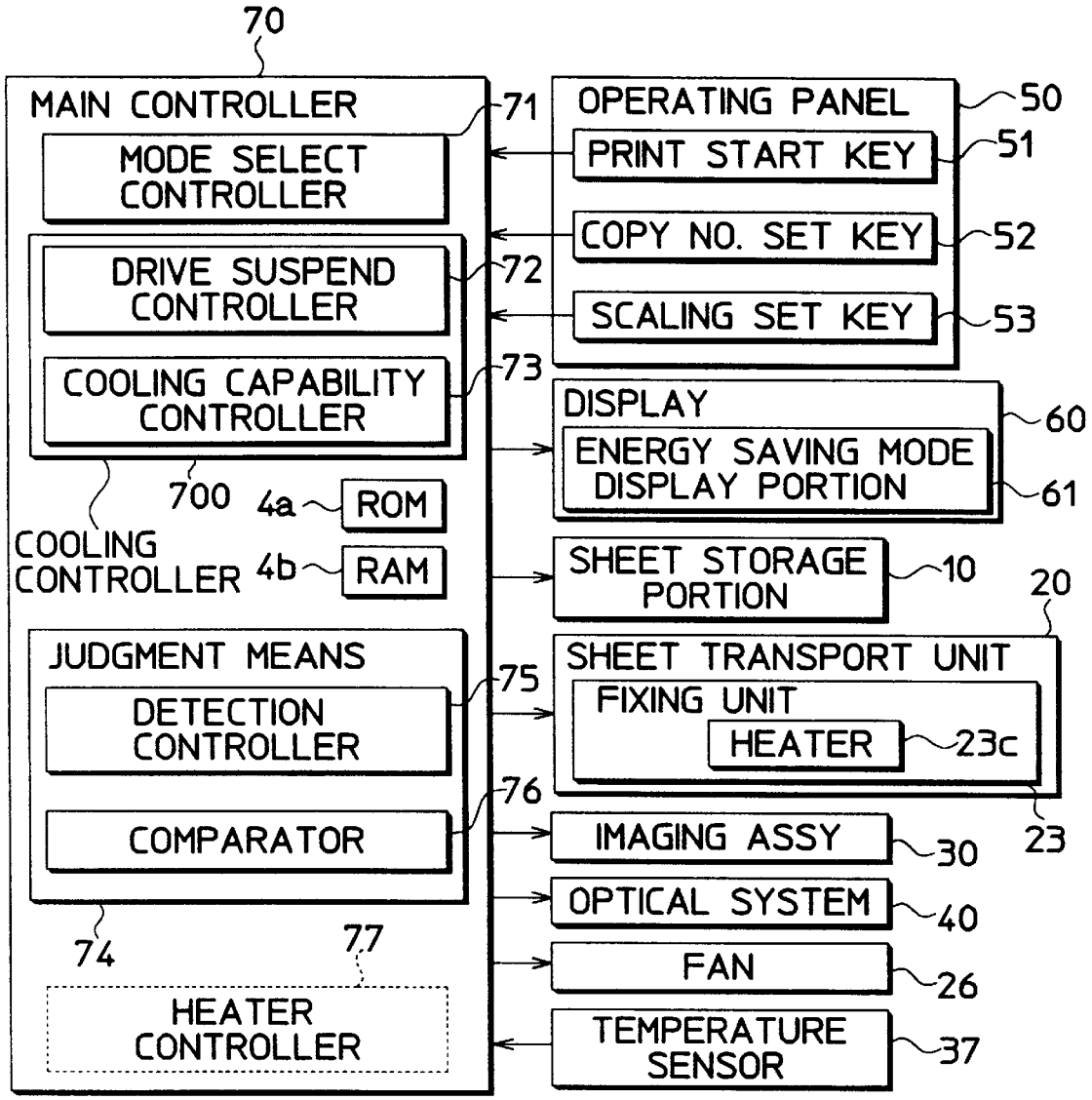
FIG. 2 is a block diagram showing a control system of the image forming apparatus.

FIG. 2 is a block diagram showing a control system of the image forming apparatus of the present invention. The image forming apparatus comprises a main controller 70 such as a microcomputer provided with a timer. The main controller 70 controls various operations of the image forming apparatus.

The image forming apparatus further comprises an operating panel 50 and a display 60. The operating panel 50 is arranged at an appropriate position on the top portion of the apparatus main body 1, and includes various operation keys such as print start key 51 for designating start of copying, number of copy set key (ten keys) 52 for setting the number of copies to be made for each original document, and scaling set key 53 for setting the scaling for copying.

The display 60 is also arranged at an appropriate position on the top portion of the apparatus main body 1. The display 60 comprises a liquid crystal display (LCD) panel and light emitting diode (LED) and is adapted for displaying instruction contents for copying, such as the number of copies set by the ten keys 52 and the scaling set by the scaling set key 53. The display 60 further includes an energy saving mode display portion 61 for displaying a message indicative that the image forming apparatus is in energy saving mode when the apparatus is set to the energy saving mode. The energy saving mode is described below.

The main controller 70 includes a ROM 4*a* for storing a control program and predetermined data, and a RAM 4*b* for temporarily storing various data such as detected temperature which is described later. When the print start key 51 is depressed, the main controller 70 controls the sheet transport unit 20, imaging assembly 30 and optical system 40 in accordance with the instruction contents set by the various operation keys in the operating panel 50, thereby initiating a copying operation.

When the image forming apparatus is operated in an operational mode, i.e., contrary to the energy saving mode, the main controller 70 controls turning on and off the heater 23*c* of the heater roller 23*a*, thereby maintaining the surface temperature of the heater roller 23*a* at a predetermined fixing temperature.

The main controller 70 further comprises a mode selecting controller 71, a drive suspension controller 72 and a cooling capability controller 73, and judgment means 74. The mode selecting controller 71 and the drive suspension controller 72 combined together are referred to as a cooling controller 700.

The mode selecting controller 71 is adapted for setting the image forming apparatus to the energy saving mode in accordance with predetermined operation procedures when a copying operation is not initiated by pressing the operation key(s) in the operating panel 50 during a predetermined duration (e.g., 10 min) and the apparatus is put into a stand-by mode. It is noted that this duration is arbitrarily settable.

When the image forming apparatus is set to the energy saving mode, the display portion 61 displays a message indicating that the apparatus is in energy saving mode. When the apparatus is in energy saving mode, other messages are prohibited from being displayed on the display 60 and power supply to the heater 23*c* of the heater roller 23*a* is also prohibited.

The drive suspension controller 72 is adapted for suspending drive (rotation) of the fan 26 after a specified time lag following the image forming apparatus being set to the energy saving mode.

The cooling capability controller 73 is adapted for selecting the condition i.e., rotational speed of the fan 26. Specifically, when the apparatus is in the operational mode, the cooling capability controller 73 controls the fan 26 to rotate at a first rotational speed $V_1$; while in the energy saving mode, the cooling capability controller 73 controls the fan 26 to rotate at a second rotational speed $V_2$, which is lower than the first speed $V_1$. In this embodiment, the first and second rotational speeds are set as: $V_2=0.5\times V_1$. The reduction rate of speed does not have to be 50% as indicated, but it rather could be set to an adequate reduction rate which best suits for the device.

The judgment means 74 includes a detection controller 75 and comparator 76. The detection controller 75 is adapted for receiving the temperature in the apparatus main body which is detected by the temperature sensor 37 at predetermined intervals for sampling as sampling data. The comparator 76 compares a currently detected temperature Tc at time (t) with a previously detected temperature Tp at time ($t-\Delta t$) which has been detected immediately before the detection of the currently detected temperature Tc. It should be noted that the notation "$\Delta t$" is some small time increment. When an output result of the comparator 76 indicates that the currently detected temperature Tc is lower than the previously detected temperature Tp the judgment means 74 judges that the temperature inside the apparatus main body 1 is lowered.

The main controller 70 further controls the mode selecting controller 71 to return the image forming apparatus to the operational mode when any operation key in the operating panel 50 is operated during the energy saving mode.

Specifically, when the print start key 51 is depressed in the energy saving mode, the main controller 70 puts the various devices for image formation in a standby mode, i.e., restricts an image formation to be initiated until it is confirmed that the surface temperature of the heater roller 23*a* is returned to the predetermined fixing temperature. Upon confirmation that the surface temperature of the heater roller 23*a* is returned to the fixing temperature, the main controller 70 allows the various devices to start specified operations for image formation. Thereby, there can be assuredly prevented poor image formation with insufficient image fixation on a copy sheet resulting from failure to reach the predetermined fixing temperature.

In addition, after the print start key 51 is depressed, the image forming apparatus is automatically returned to the operational mode from the energy saving mode after confirming that the surface temperature of the heater roller 23*a* is returned to the fixing temperature. Accordingly, an operator can promptly proceed to jobs after depressing the print start key 51, which improves efficiency of the operator.

Next, how an image is formed with the thus constructed image forming apparatus is described.

When an operator sets the scaling by the scaling set key 53, designates the number of copies by the ten keys 52, and presses the print start key 51, copying is started.

Specifically, light emitted from the exposure lamp 41 projects on a surface of an original document set on the contact glass 2 from where the reflected light is introduced to the lens unit 44 via the reflective mirrors 43*a,* 43*b* and 43*c.* Thereafter, the reflected light is directed to a specified image exposure area on the surface of the photosensitive drum 31 by way of the reflective mirrors 43*d,* 43*e* and 43*f.* At this time, the surface of the photosensitive drum 31 is uniformly charged by the main charger 31, and the specified image exposure area of the photosensitive drum surface is exposed to the light image to form an electrostatic latent image thereon. Subsequently, charged toner particles supplied from the developing unit 33 are electrically attracted to the latent image to develop the latent image into a toner image.

In the sheet storage portion 10, copy sheets stacked on the sheet placement plate 13 of the cassette 11, are fed one by one from the uppermost copy sheet by the feed roller 12 when the feed roller 12 is driven and a friction force is applied by the curved portion of the feed roller 12 on the upper surface of the uppermost copy sheet. The thus fed copy sheet is transported by the transport roller pair 21 toward the imaging assembly, and is further transported to a clearance between the photosensitive drum 31 and the transfer/separation unit 34 by the registration roller pair 22 as timed with a scanning operation of the optical system 40.

In the transfer/separation unit 34, the copy sheet has the toner image transferred from the photosensitive drum surface onto the copy sheet, is separated from the drum surface and transported to the fixing unit 23. In the fixing unit 23, the copy sheet has the transferred toner image fused with heat of the heater roller 23*a* and fixed with a pressing force of the presser roller 23*b,* while passing between the rotating heater roller 23*a* and presser roller 23*b.* After the fixation, the copy sheet is discharged onto the discharge tray 24 via the discharge roller pair 25. Thus, copy sheets, after the image formation, are discharged onto the discharge tray 24 one after another.

Figure 3:
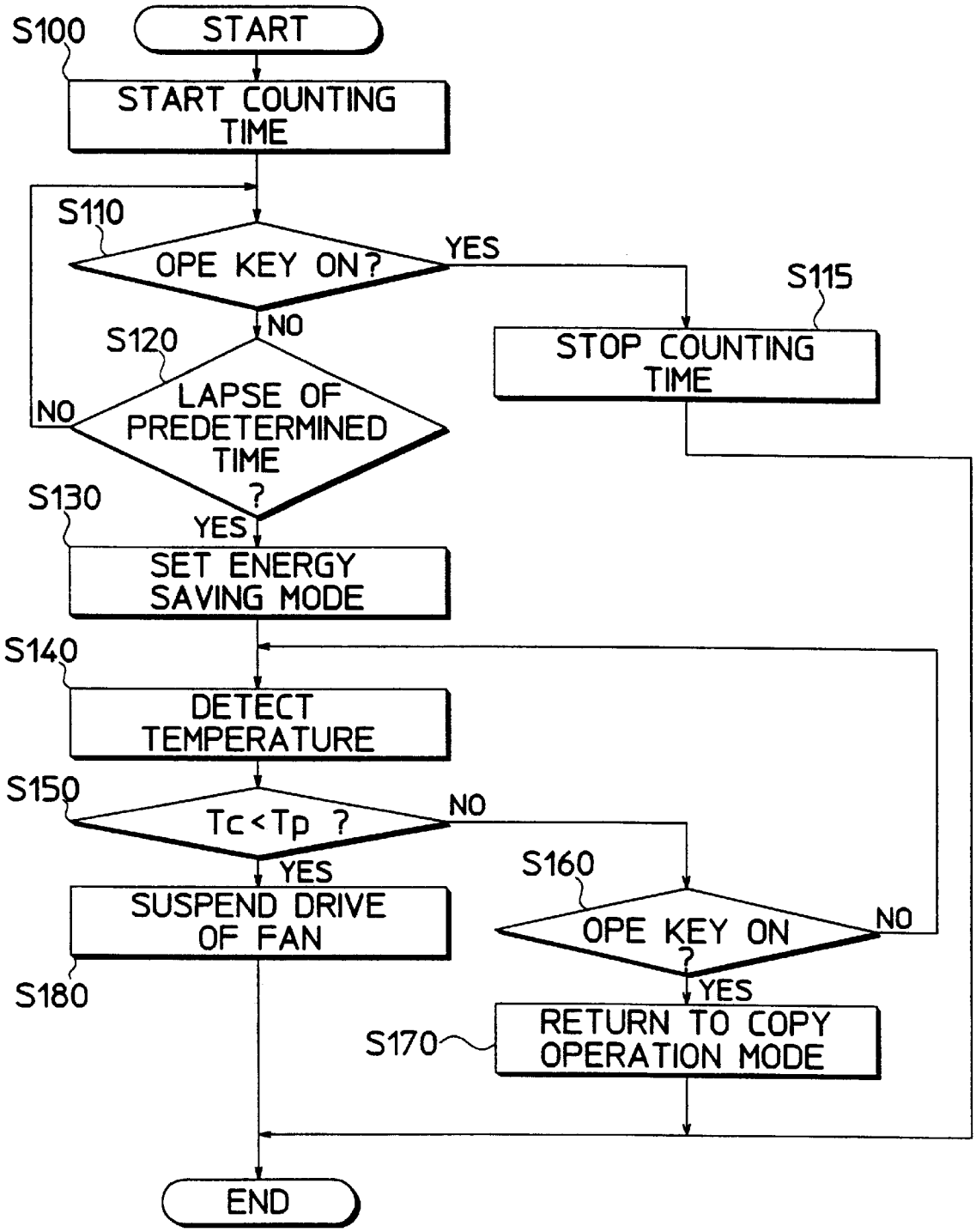
FIG. 3 is a flowchart showing operation procedures of the control system when the image forming apparatus is set in energy saving mode.

FIG. 3 is a flowchart showing operation procedures of the control system when the image forming apparatus is set to the energy saving mode.

At first, a timer starts counting of time (in Step S100). and it is judged whether any operation key in the operating panel 50 is depressed (in Step S110). If it is judged that any operation key is depressed (YES in Step S110), the timer stops counting of time, and the operation flow ends (in Step S115).

If it is judged that no operation key is depressed (NO in Step S110), then it is judged whether a predetermined time duration lapses (in Step S120). If it is judged that the predetermined duration is not elapsed (NO in Step S120), the operation flow returns to Step S110 to execute the judgment in Step S110 as well as counting of time.

If it is judged that the predetermined duration lapses in a state that no operation key is operated (YES in Step S120), the image forming apparatus is set to energy saving mode and the operation flow proceeds to Step S130. Specifically, in Step S130, supply of power to the heater 23*c* is suspended, the display portion 61 is allowed to display the message indicative that the image forming apparatus is in energy saving mode, and the rotational speed of the fan 26 is switched from the higher first speed $V_1$ to the lower second speed $V_2$.

Subsequently, the temperature sensor 37 detects the temperature inside the image forming apparatus (in Step S140), and the comparator 76 compares the currently detected temperature Tc at time (t) with the previously detected temperature Tp at time (t−Δt) to judge whether Tc<Tp (in Step S150). If Tc is not lower than Tp (NO in Step S150), then it is judged whether any operation key in the operating panel 50 is depressed (in Step S160). If it is judged that some operation key is depressed (YES in Step S160), the image forming apparatus is returned to the operational mode from energy saving mode, and this operation flow ends (in Step S170).

On the other hand, if it is judged that no operation key is depressed (NO in Step S160), the operation flow returns to Step S140 where temperature detection is carried out at predetermined intervals for sampling a series of temperature data. If it is judged that Tc<Tp (YES in Step S150), driving of the fan 26 is suspended (in Step S180).

In this way, when the image forming apparatus is set to the energy saving mode, driving of the fan 26 is suspended after a time delay following power supply to the heater 23*c* being suspended. Accordingly, rise of the temperature of the fixing unit 23 and the peripheral devices can be suppressed, thereby reliably preventing adverse effects such as heat deformation and thermal fatigue of the peripheral devices due to the rise of the temperature.

Further, when the image forming apparatus is set to the energy saving mode, the rotational speed of the fan 26 is reduced, i.e., switched from the first speed $V_1$ to the second speed $V_2$, which is about one half of the first speed $V_1$ in this embodiment, thereby suppressing energy consumption of the image forming apparatus.

In this embodiment, the temperature sensor 37 detects the temperature inside the apparatus main body 1, and driving of the fan 26 is suspended after confirming that the temperature is lowered to such a level not to adversely affect the peripheral devices. Accordingly, energy saving mode can be effected while assuredly preventing adverse effects to the peripheral devices due to still existing radiant heat of the heater 23*c*.

As shown by the dotted line in FIG. 2, the main controller 76 may be provided with heater controller 77. The heater controller 77 is adapted for controlling turning on and off the heater 23*c* to maintain the surface temperature of the heater roller 23*a* at a level lower than the fixing temperature when the image forming apparatus is set to the energy saving mode. In this case, the time required for returning the surface temperature of the heater roller 23*a* to the fixing temperature can be shortened when the operation key in the operating panel 50 is depressed to restore the image forming apparatus from the energy saving mode to the operational mode. Thereby, an operator does not have to wait a long time until the image forming apparatus is ready for copying.

Further, a temperature sensor, adapted for controlling density of toner in the developing unit 33, may be used as the temperature sensor 37 for detecting the temperature in the apparatus main body 1.

In this embodiment, driving of the fan 26 is suspended in case that it is judged that the currently detected temperature Tc is lower than the previously detected temperature Tp after the image forming apparatus is set to energy saving mode. Alternatively, the fan 26 may be controlled to suspend its operation when the judgment means 74 judges that resultant data of the detected temperature represents a state of plateau in a graph, i.e., the currently detected temperature Tc is substantially equal to the previously detected temperature Tp.

In the further alternative form, the judgment means 74 may calculate an increment (amount of temperature rise) of the currently detected temperature Tc relative to the previously detected temperature Tp each time the temperature sensor 37 detects the temperature inside the apparatus main body 1, and the main controller 70 may use the RAM 4*b* store the calculation result. When the increment at the current detection becomes smaller than the increment at the previous calculation, the judgment means 74 judges that the temperature in the apparatus main body 1 is started to be lowered. Thereupon, the main controller 70 may control the drive suspend controller 720 to suspend driving of the fan 26.

In summary, the judgment means 74 of this invention can be configured to judge when the temperature in the apparatus main body shows a sign of temperature decrease when one of the following conditions is met:

(1) when the current temperature is lower than the previously measured temperature as: Tc at time (t)<Tp at time (t−Δt)

(2) when the current temperature has not substantially changed from the previously measured temperature as: dT/dt=0;

(3) when the temperature increment at present is lower than that of the time just before the present time as: Δ(t) at time (t)<Δ(t) at time (t−Δt).

With either one of these arrangements above, adverse effects on the peripheral devices of the fixing unit can also be avoided.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

We claim:

1. An image forming apparatus wherein a toner image is transferred onto a copy sheet, the image forming apparatus comprising:

a fixing unit having a heater for fixing the toner image onto the copy sheet with heat maintained about a predetermined fixing temperature;

a cooling unit for cooling the fixing unit;

a mode selector for setting a mode of operation of the image forming apparatus to one of an energy saving mode wherein heating by the heater to maintain heat about the predetermined fixing temperature is halted upon setting of the energy saving mode and an operational mode wherein heating by is effected by the heater and the cooling unit is operated to cool the fixing unit;

a heater controller, responsive to the mode selector, for operating the heater to effect heating about the predetermined fixing temperature when the image forming apparatus is in the operational mode and ceasing operating the heater to effect heating about the predetermined fixing temperature when the image forming apparatus is set to the energy saving mode; and a cooling controller, responsive to the mode selector, for determining an elapse of a delay period starting when the image forming apparatus is set to the energy saving mode and suspending cooling operation of the cooling unit when the delay period has elapsed to prevent excessive heat buildup in the image forming apparatus and save energy.

2. The image forming apparatus according to claim 1, wherein the cooling controller includes a cooling capability controller for controlling the cooling unit to operate in one of a first cooling state at a first cooling rate during periods wherein the image forming apparatus is in the operational mode and a second cooling state at a second cooling rate upon setting of the image forming apparatus to the energy saving mode wherein the second cooling rate is less than the first cooling rate in order to save energy.

3. The image forming apparatus according to claim 2, wherein the cooling unit includes a cooling fan which is rotated at a first rotational speed when the cooling unit operates at the first cooling unit operates at the second cooling rate wherein $$V_2<\alpha\times V_1 \text{ where } \alpha\times 0.5.$$

4. The image forming apparatus according to claim 1, further comprising:

a temperature detector for detecting a temperature in an interior of the image forming apparatus;

judgment means for judging whether the temperature in the interior of the image forming apparatus is beginning to decrease when the image forming apparatus is in the energy saving mode; and the cooling controller being configured to determine that the delay period is elapsed when the judgment means judges that the temperature in the interior of the image forming apparatus is beginning to decrease.

5. The image forming apparatus according to claim 4, wherein the judgment means includes:

a detection controller for reading detected temperatures from the temperature detector at predetermined intervals; and a comparator for comparing a currently read detected temperature with a previously read detected temperature to determine whether the temperature in the interior is beginning to decrease.

6. The image forming apparatus according to claim 5, wherein the judgment means judges that the temperature in the interior of the image forming apparatus is beginning to decrease when the currently read detected temperature is lower than the previously read detected temperature.

7. The image forming apparatus according to claim 1, further comprising:

a temperature detector for detecting a temperature in an interior of the image forming apparatus;

judgment means for judging whether the temperature in the interior of the image forming apparatus is decreased, the judgment means including:

a detection controller for reading detected temperatures from the temperature detector at predetermined intervals; and a comparator for comparing a currently read detected temperature with a previously read detected temperature and determining that the temperature in the interior is decreased when the currently read detected temperature is equal to the previously read detected temperature; and the cooling controller being configured to determine that the delay period is elapsed when the judgment means judges that the temperature in the interior of the image forming apparatus is decreased.

8. The image forming apparatus according to claim 1, further comprising:

a temperature detector for detecting a temperature in an interior of the image forming apparatus;

judgment means for determining whether the temperature in the interior of the image forming device is decreased after the energy saving mode is entered, the judgement means including:

a detection controller for reading detected temperatures from the temperature detector at predetermined intervals; and a comparator for comparing a currently read detected temperature with a previously read detected temperature and calculating an increment of the currently read detected temperature relative to the previously read detected temperature each time the detection controller reads a detected temperature, and determining that the temperature in the main body is decreased when a currently calculated increment is smaller than a previously calculated increment; and the cooling controller being configured to determine that the delay period is elapsed when the judgment means judges that the temperature in the interior of the image forming apparatus is decreased.

9. The image forming apparatus according to claim 1 wherein the mode selector includes a means for setting the image forming apparatus to the energy saving mode when a copying operation is not performed over a predetermined length of time.

10. An image forming apparatus wherein a toner image is transferred onto a copy sheet, the image forming apparatus comprising:

a fixing unit having a heater for fixing the toner image onto the copy sheet with heat maintained about a predetermined fixing temperature;

a cooling unit for cooling the fixing unit;

a mode selector for setting a mode of operation of the image forming apparatus to one of an energy saving mode wherein heating by the heater to maintain heat about the predetermined fixing temperature is halted upon setting of the energy saving mode and an operational mode wherein heating by is effected by the heater and the cooling unit is operated to cool the fixing unit;

a heater controller, responsive to the mode selector, for operating the heater to effect heating about the predetermined fixing temperature when the image forming apparatus is in the operational mode and to maintain a temperature on a surface of the fixing unit at a level lower than the predetermined fixing temperature by controlling power supplied to the heater upon setting of the image forming apparatus to the energy saving mode; and a cooling controller, responsive to the mode selector, for determining an elapse of a delay period starting when the image forming apparatus is set to the energy saving mode and suspending cooling operation of the cooling unit when the delay period has elapsed to prevent excessive heat buildup in the image forming apparatus and save energy.

11. The image forming apparatus according to claim 10 wherein the mode selector includes a means for setting the image forming apparatus to the energy saving mode when a copying operation is not performed over a predetermined length of time.

12. The image forming apparatus according to claim 10, wherein the cooling controller includes a cooling capability controller for controlling the cooling unit to operate in one of a first cooling state at a first cooling rate during periods wherein the image forming apparatus is in the operational mode and a second cooling state at a second cooling rate upon setting of the image forming apparatus to the energy saving mode wherein the second cooling rate is less than the first cooling rate in order to save energy.

13. The image forming apparatus according to claim 12, wherein the cooling unit includes a cooling fan which is rotated at a first rotational speed $V_1$ when the cooling unit operates at the first cooling rate and at a second rotational speed $V_2$ when the cooling unit operates at the second cooling rate wherein:

$$V_2<\alpha\times V_1 \text{ where a } \alpha=0.5.$$

14. The image forming apparatus according to claim 10, further comprising:

a temperature detector for detecting a temperature in an interior of the image forming apparatus;

judgment means for judging whether the temperature in the interior of the image forming apparatus is beginning to decrease when the image forming apparatus is set to the energy saving mode; and the cooling controller being configured to determine that the delay period is elapsed when the judgment means judges that the temperature in the interior of the image forming apparatus is beginning to decrease.

15. The image forming apparatus according to claim 14, wherein the judgment means includes:

a detection controller for reading detected temperatures from the temperature detector at predetermined intervals; and a comparator for comparing a currently read detected temperature with a previously read detected temperature to determine whether the temperature in the interior is beginning to decrease.

16. The image forming apparatus according to claim 15, wherein the judgment means judges that the temperature in the interior of the image forming apparatus is beginning to decrease when the currently read detected temperature is lower than the previously read detected temperature.

17. The image forming apparatus according to claim 10, further comprising:

a temperature detector for detecting a temperature in an interior of the image forming apparatus;

judgment means for judging whether the temperature in the interior of the image forming apparatus is decreased, the judgment means including:

a detection controller for reading detected temperatures from the temperature detector at predetermined intervals; and a comparator for comparing a currently read detected temperature with a previously read detected temperature and determining that the temperature in the interior is decreased when the currently read detected temperature is equal to the previously read detected temperature; and the cooling controller being configured to determine that the delay period is elapsed when the judgment means judges that the temperature in the interior of the image forming apparatus is decreased.

18. The image forming apparatus according to claim 10, further comprising:

a temperature detector for detecting a temperature in an interior of the image forming apparatus;

judgment means for determining whether the temperature in the interior of the image forming device is decreased after the energy saving mode is entered, the judgement means including:

a detection controller for reading detected temperatures from the temperature detector at predetermined intervals; and a comparator for comparing a currently read detected temperature with a previously read detected temperature and calculating an increment of the currently read detected temperature relative to the previously read detected temperature each time the detection controller reads a detected temperature, and determining that the temperature in the main body is decreased when a currently calculated increment is smaller than a previously calculated increment; and the cooling controller being configured to determine that the delay period is elapsed when the judgment means judges that the temperature in the interior of the image forming apparatus is decreased.

* * * * *